US010246233B2

(12) United States Patent
Fagone

(10) Patent No.: US 10,246,233 B2
(45) Date of Patent: Apr. 2, 2019

(54) FLAP CAP

(71) Applicant: Mario Fagone, Staten Island, NY (US)

(72) Inventor: Mario Fagone, Staten Island, NY (US)

( * ) Notice: Subject to any disclaimer, the term of this patent is extended or adjusted under 35 U.S.C. 154(b) by 122 days.

(21) Appl. No.: 15/478,166

(22) Filed: Apr. 3, 2017

(65) Prior Publication Data

US 2018/0282034 A1 Oct. 4, 2018

(51) Int. Cl.

| | |
|---|---|
| ***B65D 1/02*** | (2006.01) |
| ***B65D 41/04*** | (2006.01) |
| ***B65D 53/02*** | (2006.01) |
| ***B65D 55/16*** | (2006.01) |

(52) U.S. Cl.

CPC ..... *B65D 55/16* (2013.01); *B65D 1/0246* (2013.01); *B65D 41/0471* (2013.01); *B65D 41/0485* (2013.01); *B65D 53/02* (2013.01)

(58) Field of Classification Search

CPC .... B65D 55/16; B65D 53/02; B65D 41/0485; B65D 41/0471; B65D 1/0246

USPC ..... 220/287, 375; 215/306

See application file for complete search history.

(56) References Cited

U.S. PATENT DOCUMENTS

| | | | | |
|---|---|---|---|---|
| 2,581,849 A * | 1/1952 | Fisch | B65D 35/42 | 220/288 |
| 3,199,707 A * | 8/1965 | Folkman | B01L 3/50825 | 215/306 |
| 5,398,837 A * | 3/1995 | Degrassi | B65D 51/04 | 215/306 |
| 2004/0206721 A1* | 10/2004 | Swanberg | B65D 55/16 | 215/306 |
| 2009/0255962 A1* | 10/2009 | Dressel | B65D 47/0828 | 222/543 |

* cited by examiner

*Primary Examiner* — James N Smalley
(74) *Attorney, Agent, or Firm* — Lyman Moulton, Esq.; Moulton Patents, PLLC

(57) ABSTRACT

A bottle cap retaining device comprises a flap cap configured to retain a bottle cap to a bottle and includes a lever extending from a lateral side of the flap cap and a grip extending convexly from a crown of the flap cap to the brake configured to stop the angular movement of the lever against the bottle. The device also includes a bi-tether connected to the flap cap in two places. The device additionally includes an O-ring connected to the bi-tether in two places, the O-ring includes a boss and a skirt, the boss configured on a lateral portion of the O-ring to inhibit a torque of the O-ring and the skirt configured on a bottom portion of the O-ring to provide a frictional surface against the bottle. The flap cap also comprises teeth or helical threads configured to hold a bottle cap or act in its place.

11 Claims, 10 Drawing Sheets

FLAP CAP

BACKGROUND OF THE INVENTION

Many animals, such as sea turtles, seabirds, and marine mammals have been known to ingest marine debris, which they mistake for food. This may lead to loss of nutrition, internal injury, intestinal blockage, starvation, and even death. One study found that 82 of 144 bird species examined contained small plastic debris in their stomachs, and in many species the incidence of ingestion exceeds 80% of the individuals.

Marine debris is found in all seas areas of the world—not only in densely populated regions, but also in remote places far away from any obvious sources. Marine litter originates from many sea-based and land-based sources and causes a wide spectrum of environmental, economic, safety, health and cultural impacts. The very slow rate of degradation of most marine litter items, mainly plastics, together with the continuously growing quantity of the litter and debris disposed, is leading to a gradual, but dramatic increase in the quantities of marine litter in our oceans and world shores. The majority of marine debris is composed by or originated from plastic litter, such as plastic bags and containers, bottle caps, lost or abandoned fishing nets and lines, styrofoam or small plastic pellets.

To make matters worse, the melting point for a typical bottle cap is some 100 degrees higher than for the bottle it came from. Therefore where plastic bottles are recycled, the caps are thrown away or discarded as waste into the ecosystem. Therefore for conservation purposes alone there is a need for the proper disposal of bottle caps. Additionally for convenience purposes as well there is a need to keep a bottle cap with its bottle. There has been a long unsatisfied demand in the market place for a device, system and method for management of bottle caps from a waste management and a convenience point of view.

SUMMARY OF THE INVENTION

A bottle cap retaining device comprises a flap cap configured to retain a bottle cap to a bottle and includes a lever having a brake and a grip, the lever extending from a lateral side of the flap cap, the grip extending convexly from a crown of the flap cap to the brake configured to stop the angular movement of the lever against the bottle. The device also includes a bi-tether connected to the flap cap in two places. The device additionally includes an O-ring connected to the bi-tether in two places, the O-ring includes a boss and a skirt, the boss configured on a lateral portion of the O-ring to inhibit a torque of the O-ring and the skirt configured on a bottom portion of the O-ring to provide a frictional surface against a circumference of the bottle. The flap cap also comprises teeth or helical threads configured to hold a bottle cap therein.

A method of retaining a bottle cap to a bottle is also disclosed. The method comprises retaining the bottle cap in a flap cap, the flap cap comprising a lever having a brake and a grip, the lever extending from a lateral side of the flap cap, the grip extending convexly from a crown of the flap cap to the brake configured to stop the angular movement of the lever against the bottle. The disclosed method also includes providing a tether connected to the flap cap. The method further includes retaining the flap cap to the bottle via an O-ring connected to the tether, the O-ring comprising a boss and a skirt, the boss configured on a lateral portion of the O-ring to inhibit a torqueing of the O-ring and the skirt configured on a bottom portion of the O-ring to provide a frictional surface against a circumference of the bottle.

Other aspects and advantages of embodiments of the disclosure will become apparent from the following detailed description, taken in conjunction with the accompanying drawings, illustrated by way of example of the principles of the disclosure.

Figure 1:
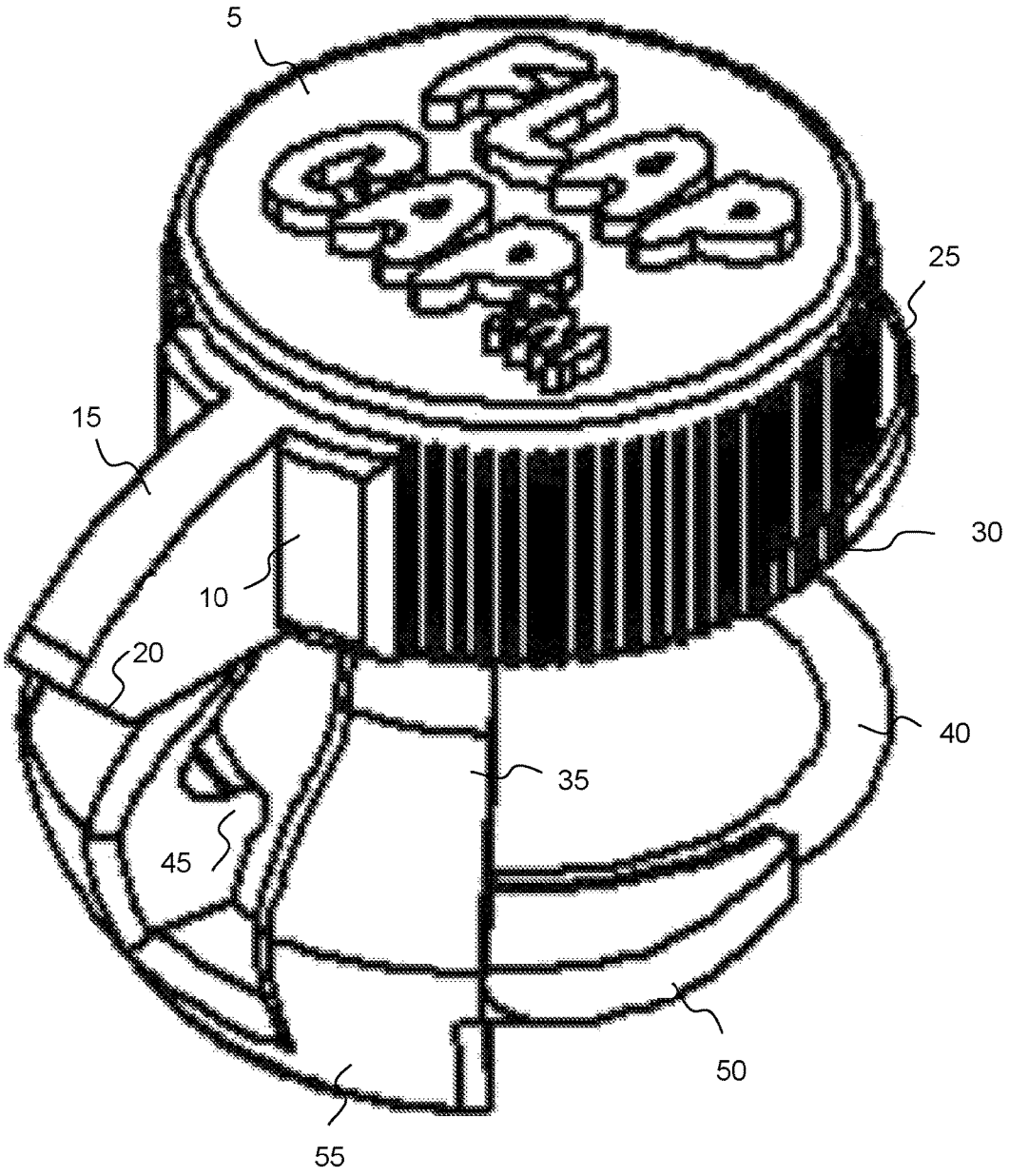
FIG. 1 is a top backside perspective view of the flap cap device in a closed engaged position depicting the lever boss, the lever grip, the O-ring skirt and the O-ring boss in accordance with an embodiment of the present disclosure.

Throughout the description, same reference numbers may be used to identify same or similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

Throughout the present disclosure, the term 'boss' refers to a protuberance or a protruding work feature used in conjunction with an O-ring, a lever, etc. The term 'flap cap' may refer to a cap component or to the whole device including the tether, the cap and the O-ring components or to a component thereof individually such as the cap portion. The term 'teeth' is descriptive and refers to rib like features which extend vertically from an inside of the cap to a mouth thereof. The term 'skirt' refers to a lower boss extending from the O-ring used to press against the bottle and prevent the O-ring from turning. The term 'lip' refers to a duck-bill like structure which provides an extended edge for flipping the cap open and closed.

Any dimensions detailed herein and in the drawings are intended to be a guide to nominal manufacturing dimensions. The detailed dimensions may vary by plus or minus ten percent taking into account manufacturing restraints and materials for various embodiments as recited, taught and suggested herein. The dimensions therefore are applicable to at least one embodiment but are not meant to be limiting to other embodiments of the disclosure.

A device for retaining a bottle cap to a bottle is disclosed. The device includes a bottle cap cover configured to retain the bottle cap therein and a tether connected to the bottle cap cover. The device also includes an O-ring connected to the tether and configured to encircle the bottle. The disclosure is therefore an add on device that captures a soda or a water bottle twist cap while also remaining linked to the bottle preventing separation of the cap from the bottle. This is accomplished by providing a friction-grip cavity that encapsulates and holds the cap and an O-ring that rests loosely around the bottle neck and stretched past the bottle flange. The loose O-ring allows the cap to be turned and removed while retaining the cap to the bottle.

A feature is provided on the device to engage the bottle flange and thus hold the cap back and away for the bottle opening while turning the bottle upside down. It also provides enough friction to lock the cap and flap cap combination in place and prevent rotation around the neck when tilting the bottle.

Another feature is provided on the device to engage the bottle and provide stability during the bending process that prevents the O-ring from twisting and also hinge support.

FIG. 1 is a top backside perspective view of the flap cap device in a closed engaged position depicting the lever boss, the lever grip, the O-ring skirt and the O-ring boss in accordance with an embodiment of the present disclosure. The disclosed device further includes a bottle cap crown 5 and an integral lever extending from a lever boss 10 at a lateral side of the bottle cap 5, the lever having a grip 15 extending convexly from the crown 5 of the bottle cap to a distal lever brake 20 point of the lever. The lever brake 20 is configured to stop the angular movement of the lever against the bottle. The flap cap device also includes a flap cap lip 25, a flap cap knurl 30, a bi-tether 35, an O-ring 40, an O-ring gap 45, an O-ring boss 50 and an O-ring skirt 55.

Figure 2:
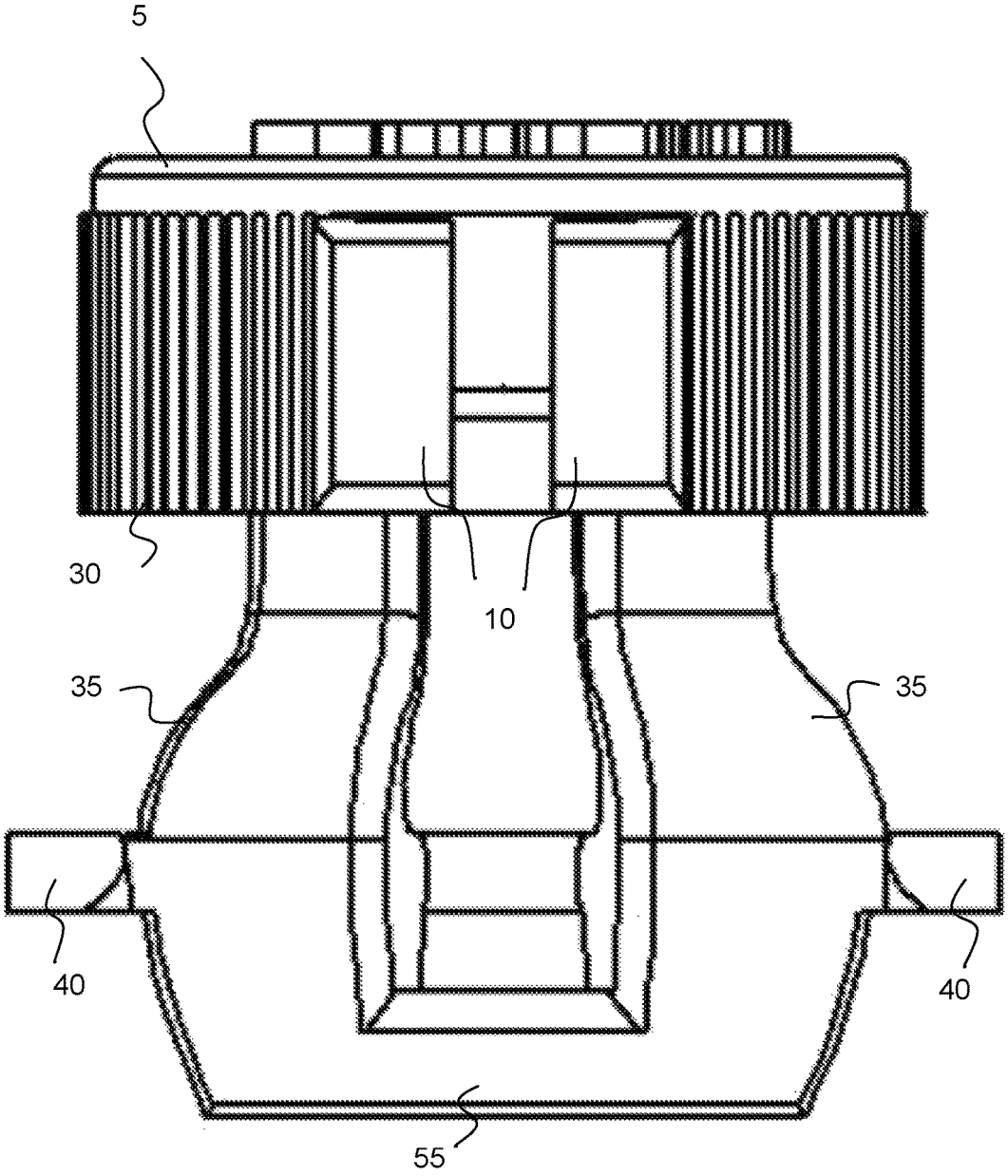
FIG. 2 is a backside elevational view of the flap cap device in a closed engaged position depicting the O-ring skirt and the O-ring boss in accordance with an embodiment of the present disclosure.

FIG. 2 is a backside elevational view of the flap cap device in a closed engaged position depicting the O-ring skirt and the O-ring boss in accordance with an embodiment of the present disclosure. The tether further comprises attachments to the bottle cap cover in at least two places. The tether further comprises a first bi-tether member and a second bi-tether member. A lateral circumference of the flap cap includes knurled edges similar to a crenellation to facilitate gripping the flap cap. A front portion of the lateral circumference includes a flap cap lip used to flip the flap cap up and away from the bottle with or without the bottle cap therein.

Figure 3:
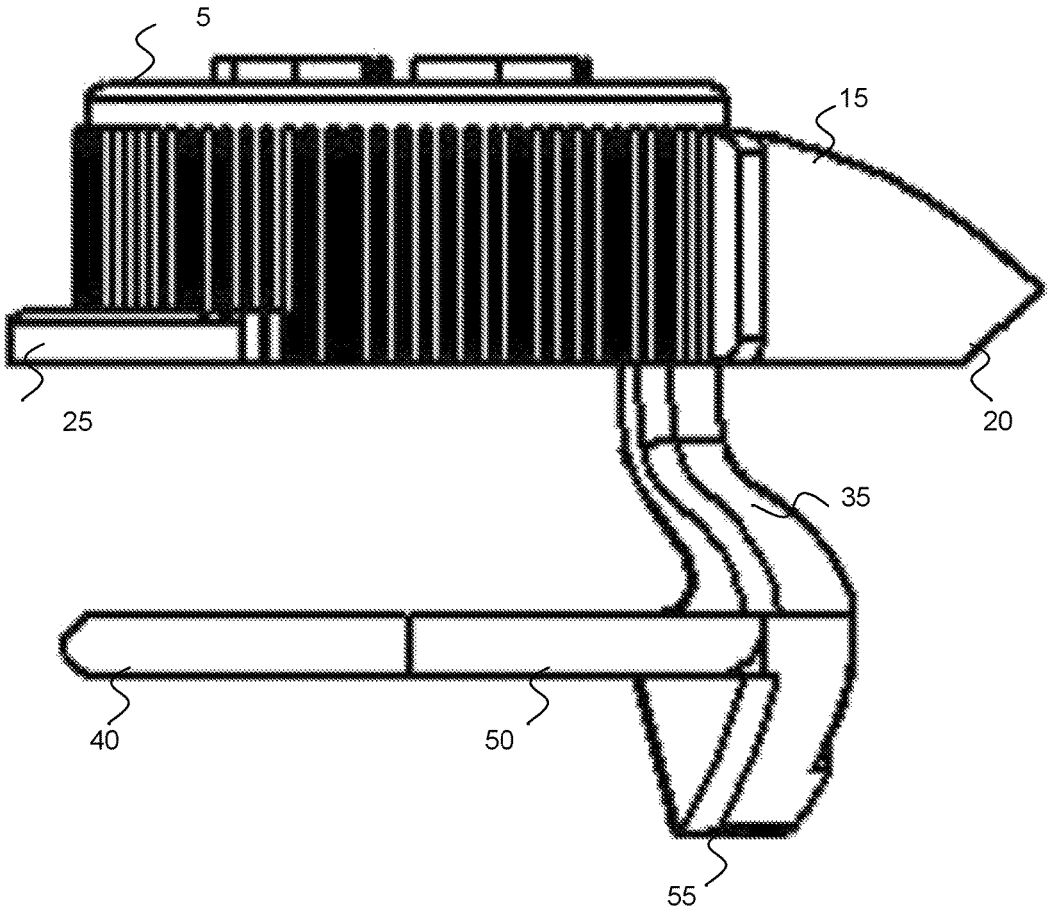
FIG. 3 is a side elevational view of the flap cap device in a closed engaged position depicting the lever components and the lip in accordance with an embodiment of the present disclosure.

FIG. 3 is a side elevational view of the flap cap device in a closed engaged position depicting the lever and the lip in accordance with an embodiment of the present disclosure. An embodiment of the disclosed device further includes an integral lever extending from a lateral side of the bottle cap cover 5, the lever having a grip 15 extending convexly from a crown of the bottle cap cover to a distal brake point 20 of the lever. The lip 25 enables a flip edge for moving the flap cap to an open position. The O-ring 40 and the O-ring boss 50 extend parallel to the flap cap in a closed position. Other references including the flap cap lip, the O-ring, the O-ring boss, the O-ring skirt, the bi-tether and the flap cap crown are similar or same to the references called out in FIG. 1.

Figure 4:
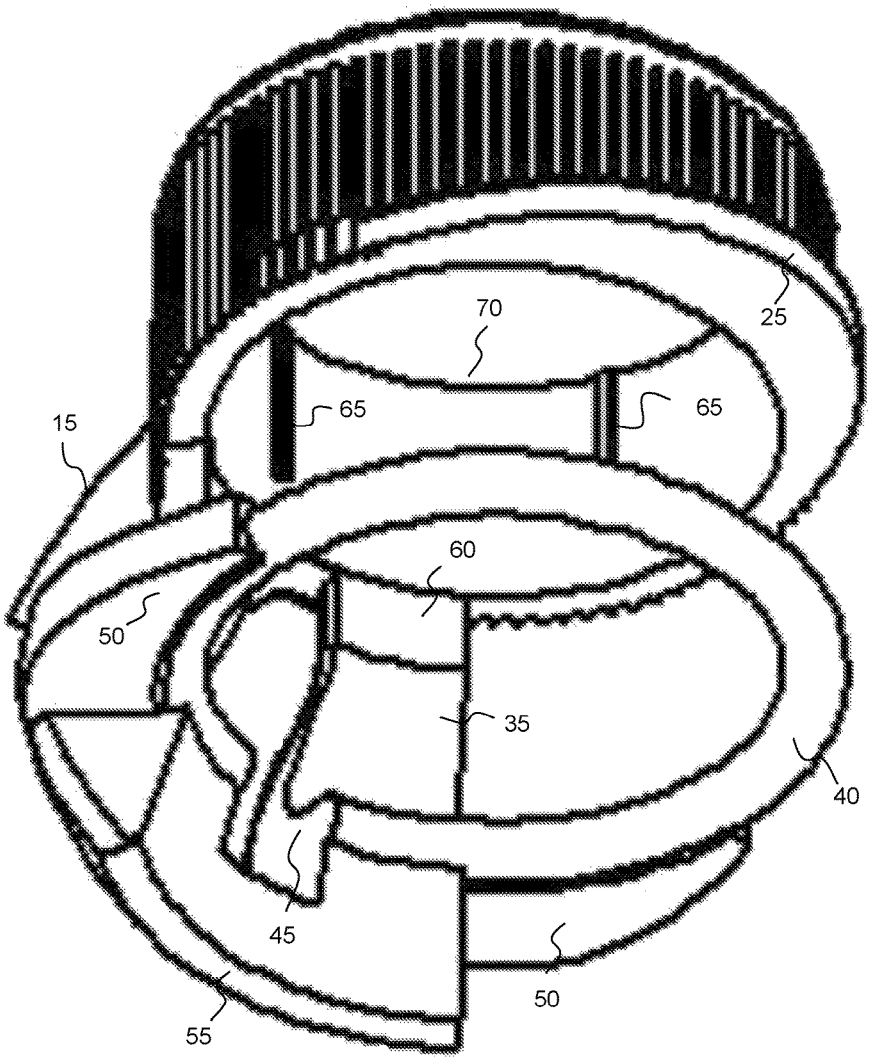
FIG. 4 is a bottom perspective view of the flap cap device in a closed engaged position depicting the flap cap teeth and the O-ring gap in accordance with an embodiment of the present disclosure.

FIG. 4 is a bottom perspective view of the flap cap device in a closed engaged position depicting the flap cap teeth in accordance with an embodiment of the present disclosure. The underside 70 of the flap cap is especially depicted herein including flap cap teeth 65 that are configured to grip and hold a bottle cap within the flap cap 5. The teeth may include vertical ribs of any number which act similar to the teeth of a gear for traction in relation to the bottle cap. The teeth are especially helpful when an operator presses the cap against the bottle cap and engage with the bottle cap to turn it and to retain it therein. Other references depicted and labeled are same or similar to the references of FIG. 1 and FIG. 2. The O-ring 40 further comprises attachments to the tether 35 in two places. The O-ring 40 defines a gap 45 in a circumference thereof, the gap 45 configured to allow a circumference of the O-ring 40 to expand. The O-ring 40 further comprises a boss 50 configured on a lateral portion of the O-ring 40 to inhibit a torqueing of the O-ring 40. The O-ring 40 further comprises a skirt 55 configured on a bottom portion of the O-ring to provide a frictional surface against a circumference of the bottle (not shown). The binary hinge 60 is configured to stay in an open position or to stay in a closed position without anything in between. The binary hinge 60 accomplishes the open and closed positions via a crook neck design which cocks back to keep the cap open and locks down to keep the cap engaged to the bottle. The binary hinge actuates at a thinner part of the tether material proximal the flap cap relative to the rest of the tether thickness.

Figure 5:
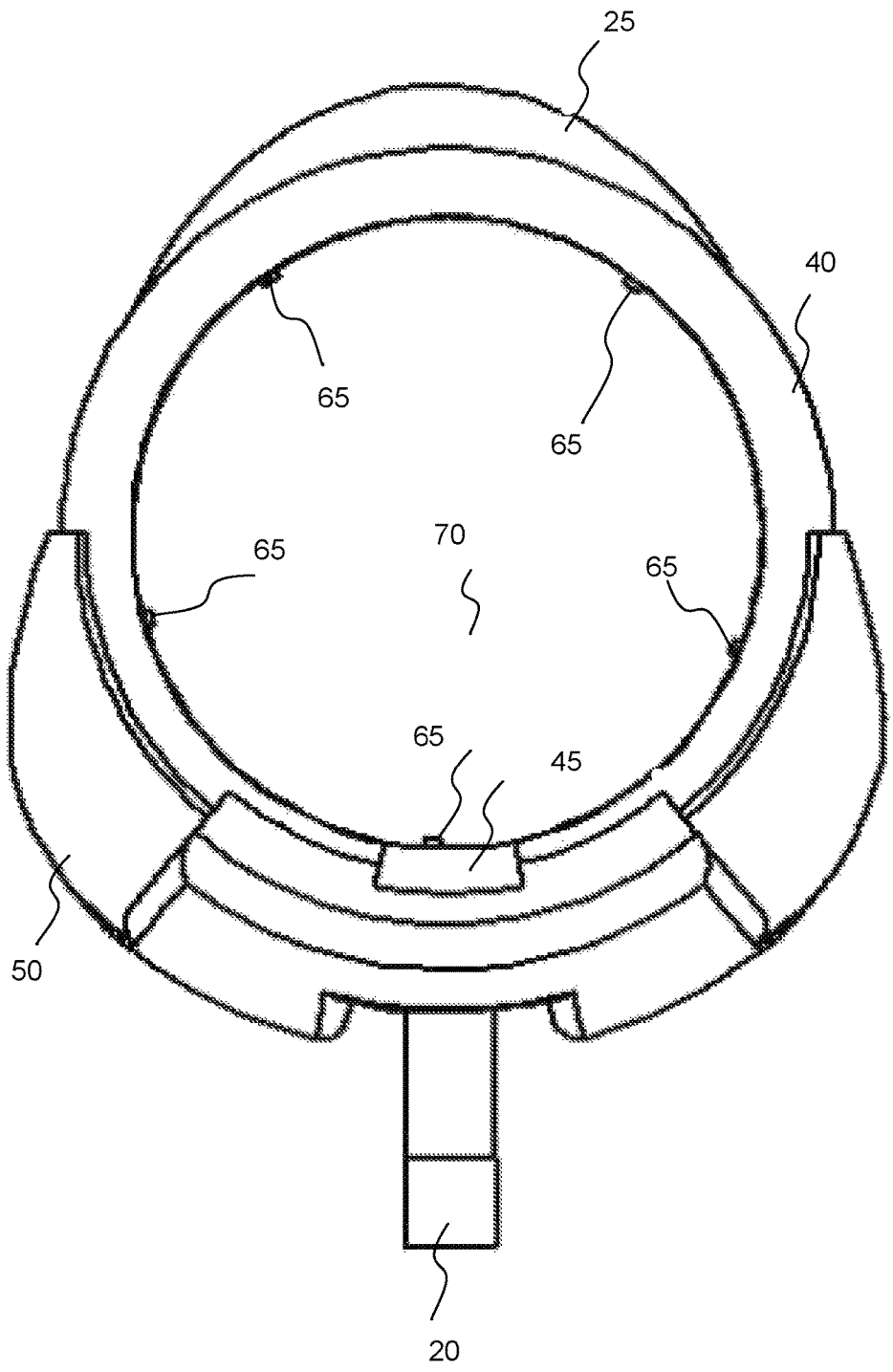
FIG. 5 is an underside elevational view of the flap cap device in a closed engaged position depicting all the flap cap teeth and the O-ring gap in accordance with an embodiment of the present disclosure.

FIG. 5 is a bottom perspective view of the flap cap device in a closed engaged position depicting helical scoring of an underside thereof in accordance with an embodiment of the present disclosure. The underside of the flap cap is especially depicted herein and may teeth 65 or include helical scoring, grooves or threads configured to grip and hold a bottle cap within the flap cap 5. Other references depicted and labeled are same or similar to the references of FIG. 1, FIG. 2 and FIG. 3. The teeth, helical grooves, scoring or threads on an underside of the flap cap help to mechanically and frictionally hold a bottle cap therein for reuse. Embodiments also include using the threaded flap cap underside as a bottle cap itself directly since the O-ring 40 allows the disclosed device to rotate around the bottle as the cap is screwed thereon.

Figure 6:
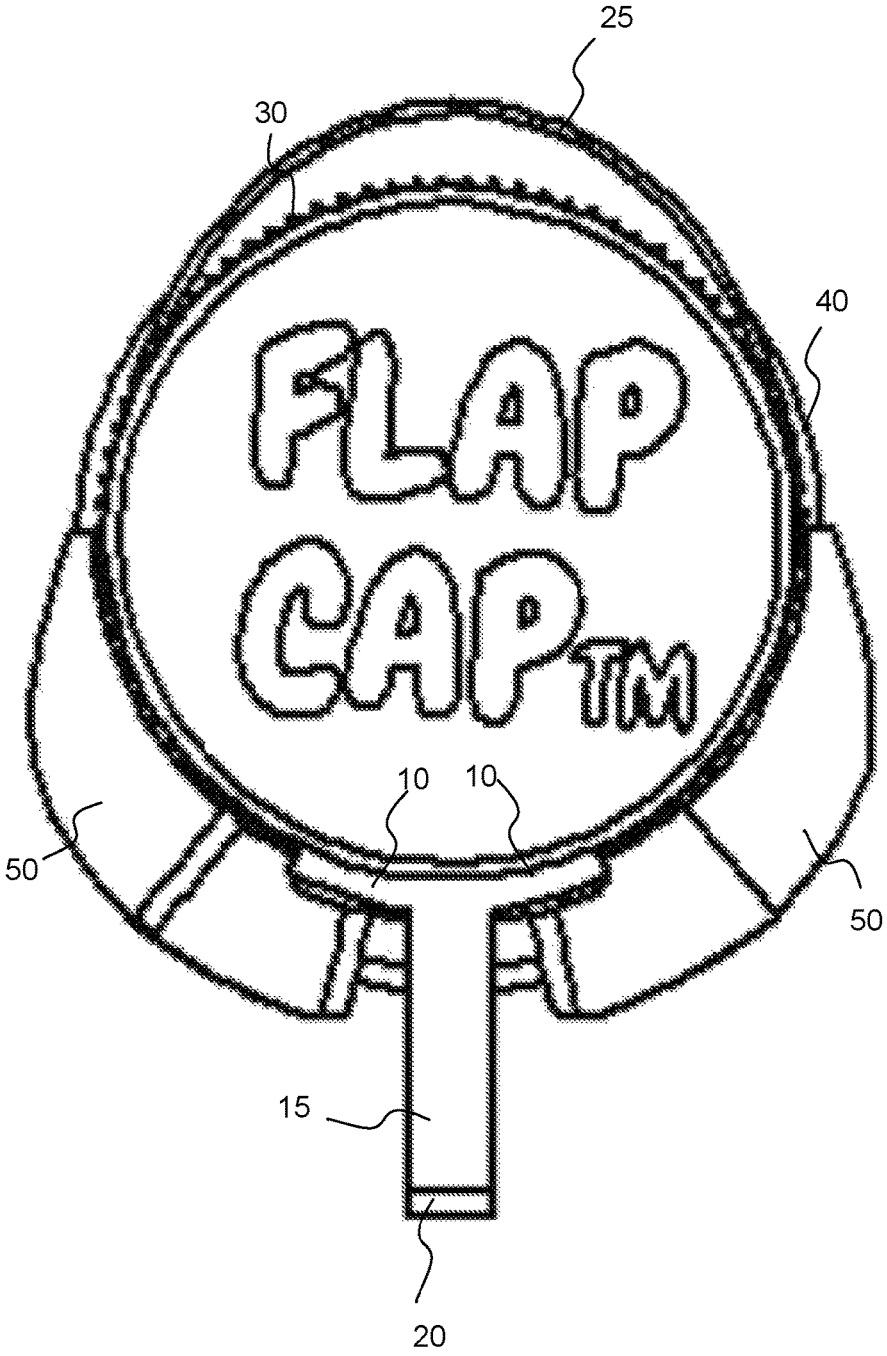
FIG. 6 is a top elevational view of the flap cap device in a closed engaged position depicting the lever boss, grip and brake in accordance with an embodiment of the present disclosure.

FIG. 6 is a top perspective view of the flap cap device in a closed engaged position depicting knurled sides and a bossed lever in accordance with an embodiment of the present disclosure. The flap cap, the tether 35 (not shown) and the O-ring 40 and components thereof comprise a low durometer material configured to stretch and remember an original shape thereof. The bi-tether 35 is configured to have a binary hinge (not shown) comprising a flap cap engaged position and a flap cap disengaged position. The flap cap further comprises a lip 25 extending radially outward from the flap cap, the lip 25 configured to provide a leverage extension for an angular movement of the flap cap. The flap cap further comprises a knurled 30 outside lateral circumference configured to facilitate twisting the flap cap. The lever boss 10 depicted on both sides of the lever adjacent the lateral circumference of the flap cap reinforces the lever against lateral movement.

Figure 7:
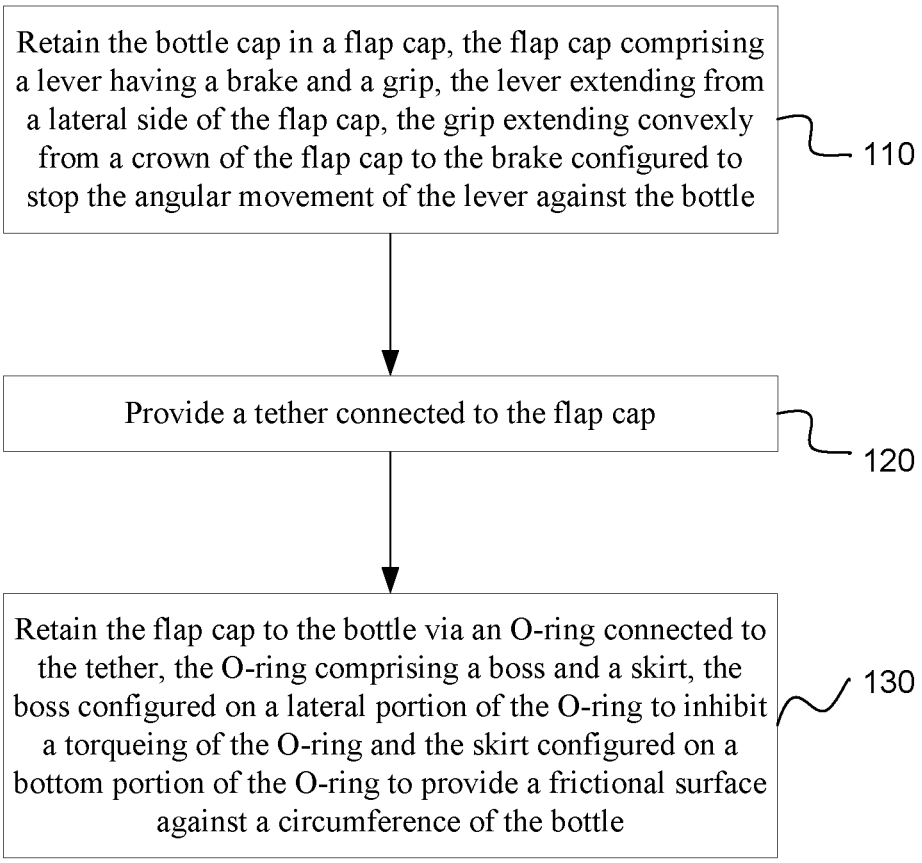
FIG. 7 is a flow chart of a method for retaining a bottle cap to a bottle in a flap cap device via a tether and an O-ring in accordance with an embodiment of the present disclosure.

FIG. 7 is a flow chart of a method for intelligently inhibiting shaking in accordance with an embodiment of the present disclosure. A method of retaining a bottle cap to a bottle is also disclosed. The method comprises retaining 110 the bottle cap in a flap cap, the flap cap comprising a lever having a brake and a grip, the lever extending from a lateral side of the flap cap, the grip extending convexly from a crown of the flap cap to the brake configured to stop the angular movement of the lever against the bottle. The disclosed method also includes providing 120 a tether connected to the flap cap. The method further includes retaining 130 the flap cap to the bottle via an O-ring connected to the tether, the O-ring comprising a boss and a skirt, the boss configured on a lateral portion of the O-ring to inhibit a torqueing of the O-ring and the skirt configured on a bottom portion of the O-ring to provide a frictional surface against a circumference of the bottle.

Figure 8:
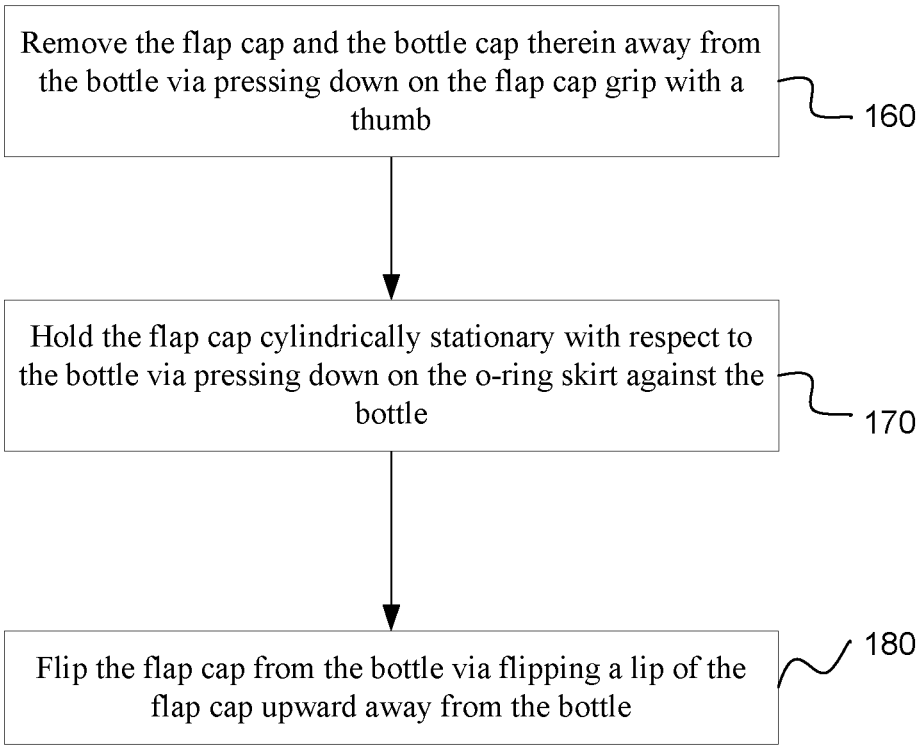
FIG. 8 is a flow chart of a method for disengaging a bottle cap retained to a bottle in a flap cap device via a tether and an O-ring in accordance with an embodiment of the present disclosure.

FIG. 8 is a flow chart of implementation methods for intelligently inhibiting shaking in accordance with an embodiment of the present disclosure. An embodiment of the method also includes removing 160 the flap cap and the bottle cap therein away from the bottle via pressing down on the flap cap grip with a thumb. The embodiment further includes holding 170 the flap cap cylindrically stationary with respect to the bottle via pressing down on the o-ring skirt against the bottle. The embodied method yet includes flipping 180 the flap cap from the bottle via flipping a lip of the flap cap upward away from the bottle.

Figure 9:
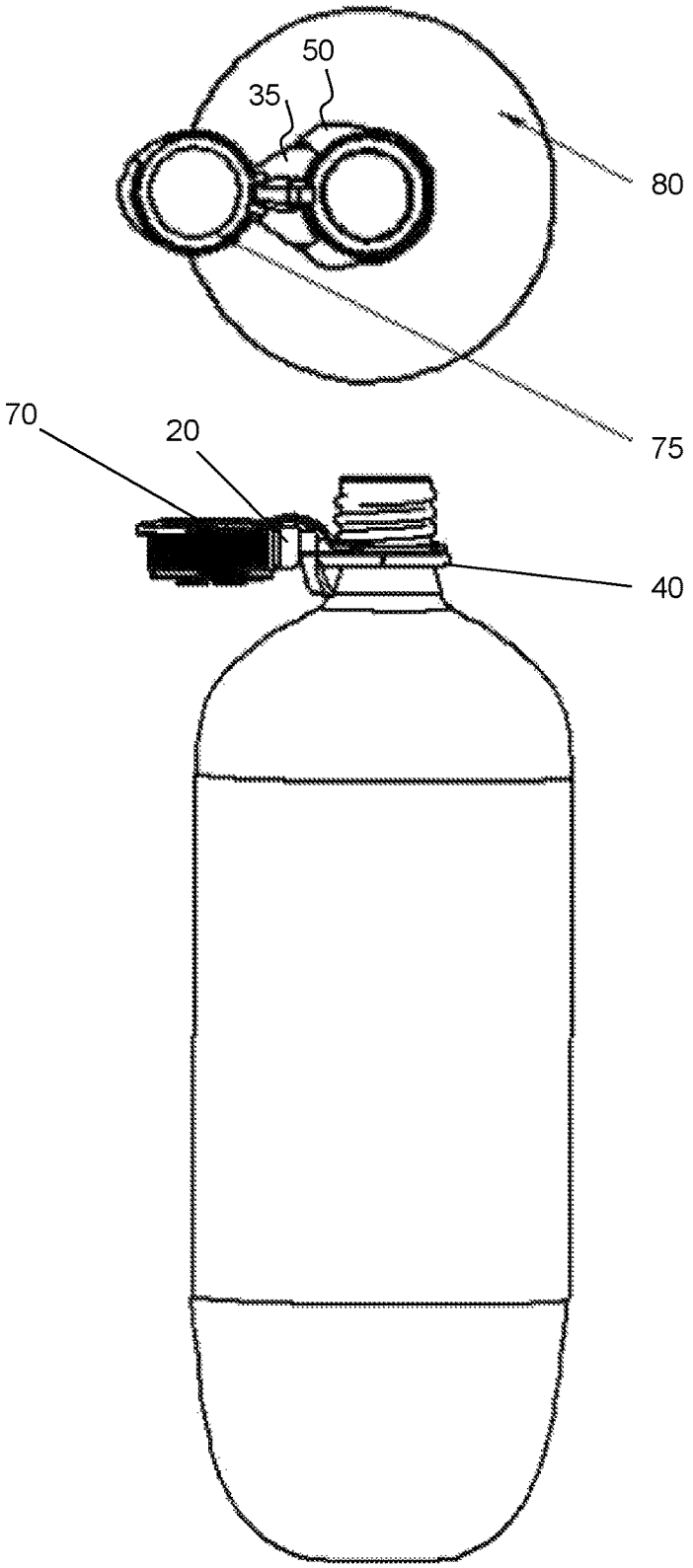
FIG. 9 is a split view elevational depiction of the disclosed device in an open configuration on a bottle showing a side view and a top view in accordance with an embodiment of the present disclosure.

FIG. 9 is a split view depiction of the disclosed device in an open configuration on a bottle showing a side view and a top view in accordance with an embodiment of the present disclosure. The exemplary bottle 80 is a commercially available bottle for water, beverages, etc. The O-ring 40 is stretched over a flange lip of the bottle opening and the flap can is flipped into a locking opening binary position. The split top view depicts a bottle cap captured inside the flap cap. The split side view depicts the O-ring 40 beneath the flange lip of the bottle. Also depicted and called out are the lever brake 20, the underside of the cap 70, and a bottle cap 75, a portion of the bi-tether 35 and a portion of the O-ring boss 50. The lever brake 20 rests above the flange lip of the bottle in the open position. The flap cap device may fit any number of bottle designs, canister designs, tank designs and cylindrical containers with or without flanges, cap threads and constricting necks.

Figure 10:
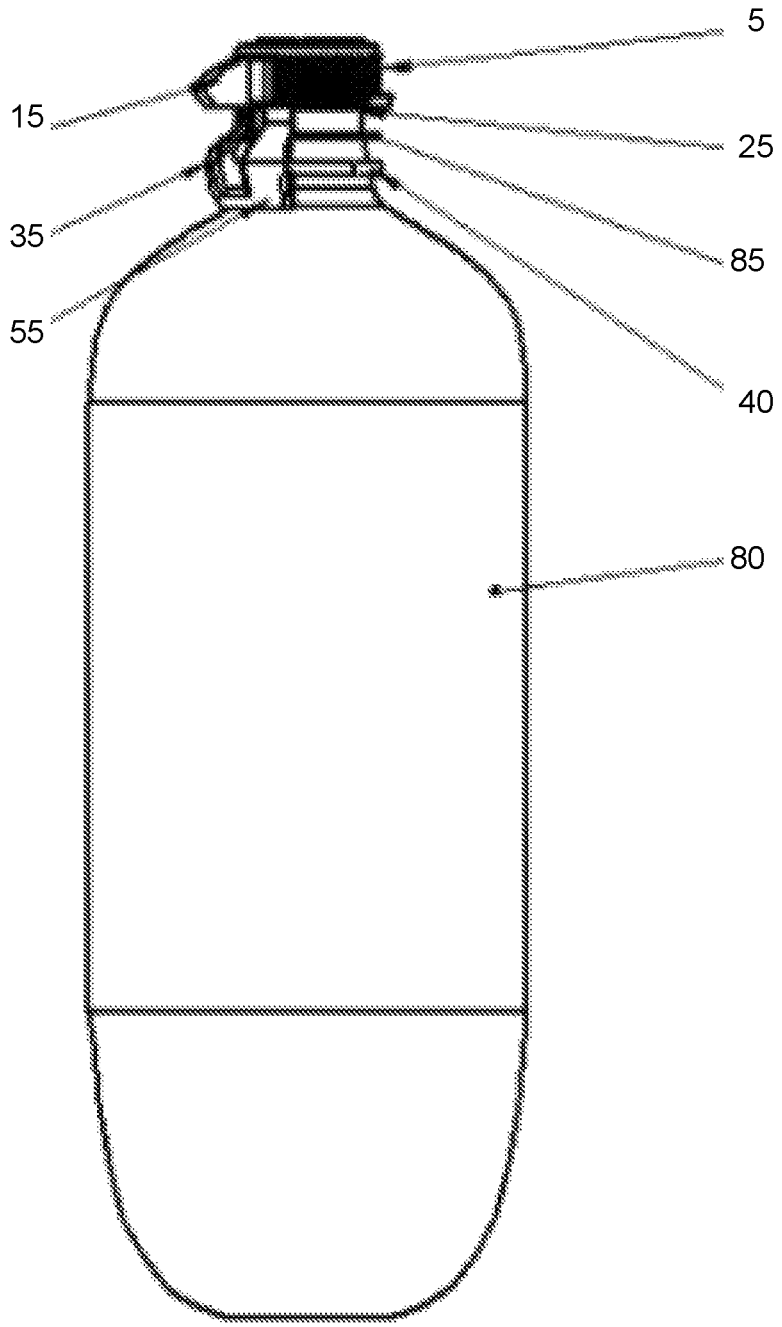
FIG. 10 is an elevational view of the disclosed device in a closed configuration on a bottle in accordance with an embodiment of the present disclosure.

FIG. 10 is a perspective view depiction of the disclosed device in a closed configuration on a bottle in accordance with an embodiment of the present disclosure. References depicted here to limitations of the present disclosure are the same or similar to references depicted in other drawings herein. The perspective view of the disclosed device depicts the bi-tether 35 connections to the flap cap 5 and to the O-ring 40. The O-ring skirt 55 is shown against the bottle neck. The O-ring is shown beneath the bottle flange 85. Other bottles may be accommodated by the disclosed device adapted for a larger O-ring and a larger flap cap.

The present disclosure therefore meets the long felt need in the market for a device designed and engineered for the management of bottle caps. The present disclosure provides a means for retaining a bottle cap to the bottle during use and during storage. The present disclosure also enables a capping of the bottle directly with the device itself during use and storage. The disclosed device conveniently allows a user to tether the bottle cap aside by the use of a lever, a lever grip and a lever brake. The disclosed device also avoids the inconveniences of twisting O-rings and non-stationary O-rings.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

While the forgoing examples are illustrative of the principles of the present disclosure in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the disclosure be limited, except as by the specification and claims set forth herein.

What is claimed is:

1. A device for retaining a bottle cap to a bottle, the device comprising:

a flap cap configured to retain the bottle cap therein, the flap cap comprising a lever having a brake and a grip, the lever extending from a lateral side of the flap cap, the grip extending convexly from a crown of the flap cap to the brake configured to stop the angular movement of the lever against the bottle;

a bi-tether connected to the flap cap in two places; and an O-ring connected to the bi-tether in two places, the O-ring comprising a boss and a skirt, the boss configured on a lateral portion of the O-ring to inhibit a torqueing of the O-ring and the skirt configured on a bottom portion of the O-ring to provide a frictional surface against a circumference of the bottle.

2. The bottle cap retaining device of claim 1, wherein the flap cap comprises teeth therein configured to one of grip and hold the bottle cap therein.

3. The bottle cap retaining device of claim 1, wherein the flap cap comprises helical threads therein configured to one of grip and hold the bottle cap therein and to act in its place.

4. The bottle cap retaining device of claim 1, wherein the flap cap, the tether and the O-ring and components thereof comprise a low durometer material configured to stretch and remember an original shape thereof.

5. The bottle cap retaining device of claim 1, wherein the bi-tether is configured to have a binary hinge comprising a flap cap engaged position and a flap cap disengaged position.

6. The bottle cap retaining device of claim 1, wherein the flap cap further comprises a lip extending radially outward from the flap cap, the lip configured to provide a leverage extension for an angular movement of the flap cap.

7. The bottle cap retaining device of claim 1, wherein the flap cap further comprises a knurled outside lateral circumference configured to facilitate twisting the flap cap.

8. A method of retaining a bottle cap to a bottle, the method comprising:

retaining the bottle cap in a flap cap, the flap cap comprising a lever having a brake and a grip, the lever extending from a lateral side of the flap cap, the grip extending convexly from a crown of the flap cap to the brake configured to stop the angular movement of the lever against the bottle;

providing a tether connected to the flap cap; and retaining the flap cap to the bottle via an O-ring connected to the tether, the O-ring comprising a boss and a skirt, the boss configured on a lateral portion of the O-ring to inhibit a torqueing of the O-ring and the skirt configured on a bottom portion of the O-ring to provide a frictional surface against a circumference of the bottle.

9. The method of retaining a bottle cap of claim 8, further comprising removing the flap cap and the bottle cap therein away from the bottle via pressing down on the flap cap grip with a thumb.

10. The method of retaining a bottle cap of claim 8, further comprising holding the flap cap cylindrically stationary with respect to the bottle via pressing down on the O-ring skirt against the bottle.

11. The method of retaining a bottle cap of claim 8, further comprising flipping the flap cap from the bottle via flipping a lip of the flap cap upward away from the bottle.

* * * * *